US012364317B2

(12) United States Patent
Williams

(10) Patent No.: US 12,364,317 B2
(45) Date of Patent: Jul. 22, 2025

(54) JEWELRY ITEMS CONFIGURED TO RELEASABLY SET ONE OR MORE BEADS

(71) Applicant: Paul Derrick Williams, Leichhardt (AU)

(72) Inventor: Paul Derrick Williams, Leichhardt (AU)

(73) Assignee: Paul Derrick Williams

( * ) Notice: Subject to any disclaimer, the term of this patent is extended or adjusted under 35 U.S.C. 154(b) by 585 days.

(21) Appl. No.: 17/164,869

(22) Filed: Feb. 2, 2021

(65) Prior Publication Data

US 2021/0235825 A1 Aug. 5, 2021

Related U.S. Application Data

(60) Provisional application No. 62/969,170, filed on Feb. 3, 2020.

(51) Int. Cl.

| | |
|---|---|
| ***A44C 17/02*** | (2006.01) |
| ***A44C 1/00*** | (2006.01) |
| ***A45D 8/00*** | (2006.01) |

(52) U.S. Cl.

CPC ..... *A44C 17/025* (2013.01); *A44C 1/00* (2013.01); *A44C 17/0216* (2013.01); *A45D 8/006* (2021.01)

(58) Field of Classification Search

CPC ..... A44C 17/0208; A44C 17/0216; A44C 17/0225; A44C 17/0241; A44C 17/025; A44C 17/0258; A44C 17/0266; A44C 25/00; A44C 25/001; A44C 1/00; A44C 7/00; A45D 8/006

USPC ..... 63/40, 29.1, 30

See application file for complete search history.

(56) References Cited

U.S. PATENT DOCUMENTS 4,977,757 A * 12/1990 Mesica ..... A44C 9/00 63/29.1

2017/0020244 A1* 1/2017 Chan ..... A44C 17/0216

FOREIGN PATENT DOCUMENTS

KR 20090039288 A * 2/2009

KR 20090019963 A * 4/2009

* cited by examiner

*Primary Examiner* — Jack W Lavinder

(57) ABSTRACT

Jewelry items with various embodiments configured to releasably set one or more beads. The jewelry items are configured in such a way that allows users to change one or more beads quickly and easily within the jewelry items. The embodiments and alternatives may also be used as a therapeutic aid, for relaxation and other uses. The various embodiments comprise movable parts including one or more springs to supply the spring force to change the beads quickly and easily.

12 Claims, 10 Drawing Sheets

FIG.3
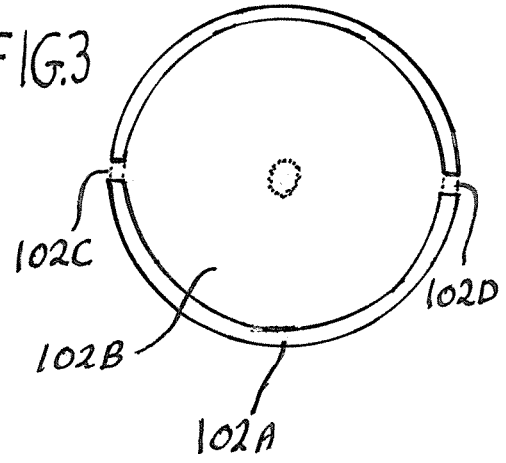
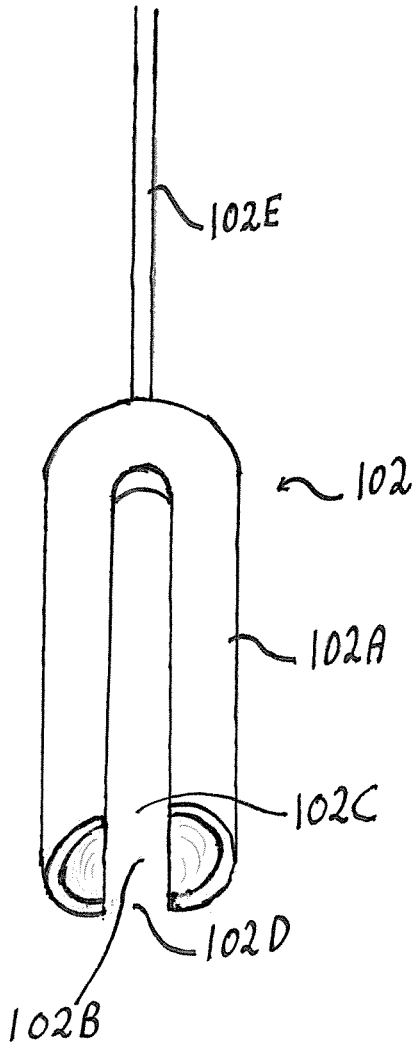
FIG.4
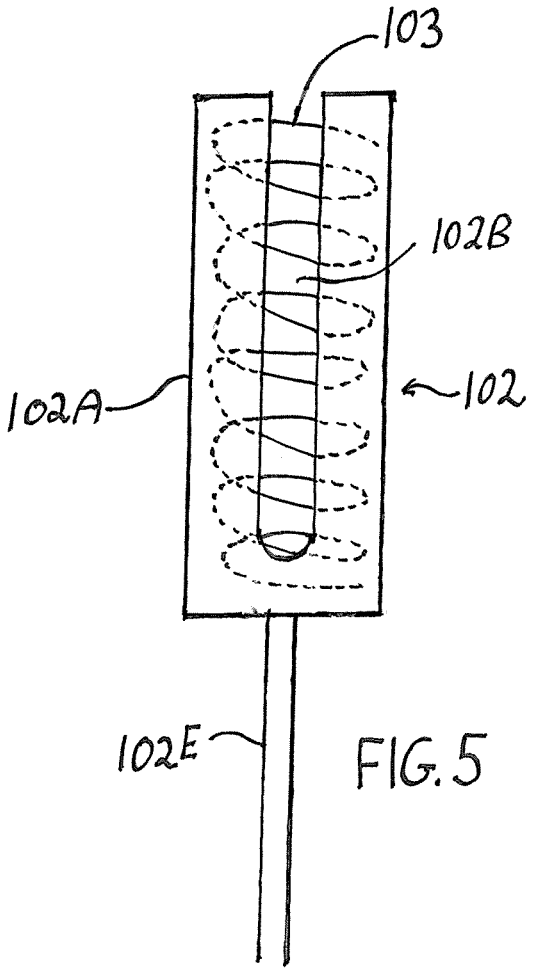
FIG.5

JEWELRY ITEMS CONFIGURED TO RELEASABLY SET ONE OR MORE BEADS

CROSS-REFERENCE TO RELATED APPLICATIONS

This application claims priority to and the benefits of U.S. Provisional Patent Ser. No. 62/969,170 which was filed on Feb. 3, 2020.

TECHNICAL FIELD

Embodiments of the invention relates to jewelry. More particularly the invention relates to jewelry items configured to releasably set one or more beads.

BACKGROUND OF THE INVENTION

Traditionally, it is well known in the art that different types of beaded jewelry items such as necklaces, rings, earrings, pendants, bracelets etc are adorned with one or more beads permanently strung into the jewelry pieces. For example, it is common to permanently string beads into a beaded jewelry item such as a necklace using plastic wire or metal wire to thread the beads together in a continuous strand. These wires may be flexible or solid. All of these teachings demonstrate limitations that embodiments of the herein invention overcomes.

A single bead or a plurality of beads permanently set by stringing them onto a necklace or any other jewelry item may be a desirable outcome in some situations. For example, if the bead is a rare expensive opal the wearer may desire the opal to be permanently and securely set into a pendant. However, in other situations a wearer may want to change the bead(s) quickly and easily in a jewelry item to meet their preferences. For example, a wearer may have a pair of sterling silver jewelry dangle earrings and a matching pendant, each having permanently set blue beads strung into the pieces. However, the jewelry pieces with the blue beads may not cosmetically match a red dress or any other number of clothing items in the opinion of the wearer. Or the wearer may simply want different colored beads in those particular sterling silver jewelry pieces for personal tastes.

The problem is that the wearer cannot easily and quickly change the beads in that jewelry set because they are permanently set by being permanently strung into each jewelry item. Some wearers may have the technical ability to change the beads in simple wired settings, but in more complex bead settings they risk damaging the jewelry piece in the process; as permanently setting and removing beads in more complex jewelry settings is work for those skilled in the art. The only quick and logical solution for the wearer is to buy another set of the same jewelry, if available, with different colored beads, if available. This may become costly especially if the bead setting and the jewelry item is made of a precious metal such as platinum, gold, or sterling silver.

Some attempts have been made to overcome this problem. For example, U.S. Pat. No. 6,318,122B (Burgard) discloses a finger ring with a screw in system for interchangeable ornaments or beads. However, the beads sit exceedingly high above the finger and this may not be cosmetically pleasing or desirable for many wearers, plus the customization options are limited. The beads can be interchanged but the system is bulky and may lack cosmetic appeal in some wearers opinion.

In another example, U.S. Pat. No. 7,007,507 (Pandora Jewelry LLC), discloses a popular system for interchanging bead-like charms. However, this system is only suitable for bulkier type jewelry items such as bracelets and necklaces and does not accommodate small beads or petite jewelry. These examples have many limitations as shown and there is clearly a need for an invention that overcomes these limitations as will be clearly outlined in the description of the disclosed embodiments of the invention.

A new structure(s) is needed to be able to quickly and easily interchange various types and sizes of beads, including charms, in jewelry items. This invention discloses embodiments of these new structures that are suitable for both bulky and petite jewelry pieces such as small dangle earrings etc, as will be demonstrated in the following disclosure.

SUMMARY OF THE INVENTION

The following presents a simplified summary of the invention in order to provide a basic understanding of some aspects of the invention. It is intended to neither identify all the elements and configurations of the invention nor delineate the scope of the invention. Its purpose is to present some concepts of the invention in a simplified form as to preclude the more detailed description that is presented later.

An object of the invention is to provide different embodiments of jewelry items configured to releasably set one or more beads. The different embodiments with alternatives and variations remain within the scope of the invention.

Jewelry items as further described in the disclosure being configured to releasably set one or more beads, the jewelry items comprising: one or more springs configured adjacent to one or more setting members, and other components to releasably set one or more beads.

Another object of the invention is to provide different embodiments of jewelry items configured to releasably set one or more beads for use as a relaxation or therapy aid; use as a toy; use as an educational tool; and use as an amusement apparatus.

The jewelry items configured to releasably set one or more beads can further comprise handbags, buckles, fashion items, decorative items, clothing, watches, handbags, shoes, eyewear, hats, and toys.

Another object of the invention is to demonstrate how setting members may also be releasably set to a body portion of jewelry items configured to releasably set at least one or more beads.

BRIEF DESCRIPTION OF THE DRAWINGS

FIG. 3 shows an aerial view of the open end of the tube portion of the first embodiment before an end cap is structurally connected.

FIG. 4 shows further details from a different angle of the portions configured in the setting member in the first embodiment before an end cap is structurally connected.

FIG. 5 shows how a spring in configured in the first embodiment in the hollow portion of the tube portion before an end cap is structurally connected.

DETAILED DESCRIPTION OF THE EMBODIMENTS

Beads

One non-limiting definition of a bead is a decorative object that is formed in a variety of shapes and sizes of a material such as gemstone, stone, bone, shell, glass, plastic, wood, pearl, metal, etc, and any combinations thereof, and has a hole for stringing/threading. Beads may be strung onto straight wire, flexible wire string, fabric string, nylon string etc. Many types of charms are considered to be beads and are known in the art as bead charms.

Releasably Set

Releasably set means that one or more beads can be added by a user to, and removed from, jewelry items configured to releasably set at least one or more beads, using at least one spring in the embodiment to supply assisting spring force. Releasably set also applies to the substantially cylindrical stringing portion of a setting member. For clarification, using the first embodiment as a non-limiting example, wherein a movable setting member is structurally connected to the body portion.

The substantially cylindrical stringing portion of the movable setting member, with or without added beads can be connected to and removed from the cavity portion of the body portion, while the movable setting member remains structurally connected to the body portion of the jewelry item, as will be demonstrated in the subsequent description of the first embodiment.

Releasably set also applies to the whole setting member. Using the second embodiment as another non-limiting example, wherein the movable setting member is not structurally connected to the body portion. The complete setting member may be removed from or added to the body portion of the jewelry item, with or without beads added to the substantially cylindrical stringing portion of the setting member as will be demonstrated in the subsequent description of the second embodiment.

First Embodiment

Figure 1:
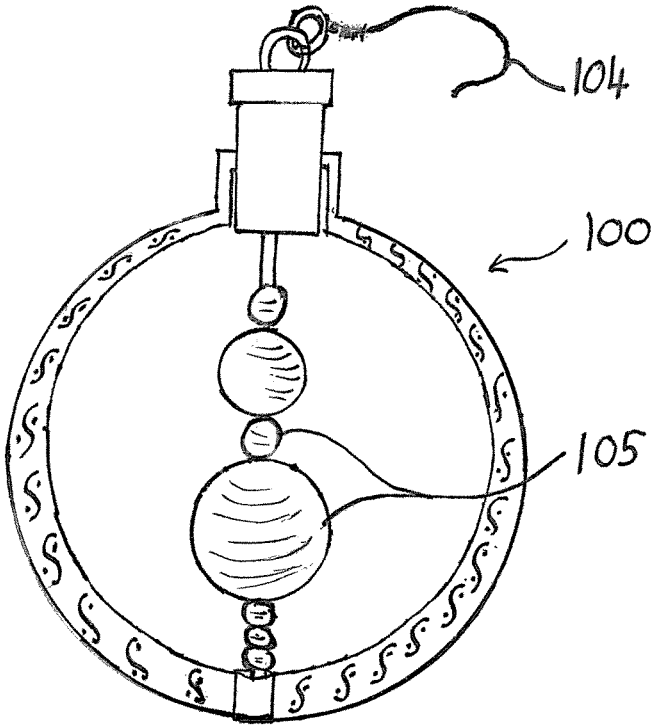
FIG. 1 shows a general front view of the first embodiment with releasably set beads.
Figure 2:
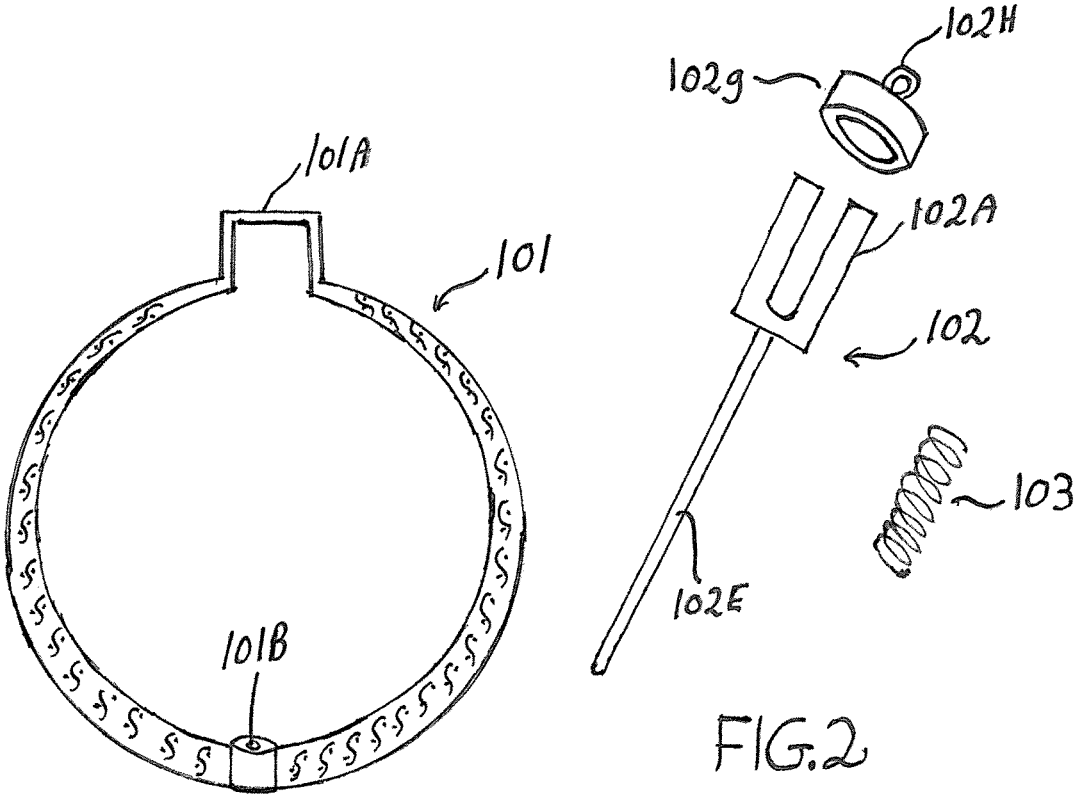
FIG. 2 shows the individual components of the first embodiment without beads.

FIGS. 1 and 2 shows the components of the first embodiment (embodiment 100); a jewelry item configured to releasably set one or more beads. In this non-limiting configuration of embodiment 100, the jewelry item is a dangle earring, however, the subsequent demonstrated structure, function and connection can be adapted to other types of jewelry such as but not limited to rings, pendants, and bracelets, etc, while keeping within the scope of the inventive concept.

Structure

FIG. 1 shows a general front view of embodiment 100 with releasably set beads. As shown in FIG. 2, embodiment 100 comprises a body portion 101; the body portion 101 further comprising a substantially cylindrical connecting portion 101*a* and a cavity portion 101*b*. Embodiment 100 further comprises a setting member 102, the setting member 102 further comprises a substantially cylindrical tube portion 102*a* and a substantially cylindrical stringing portion 102*e*.

Figure 6:
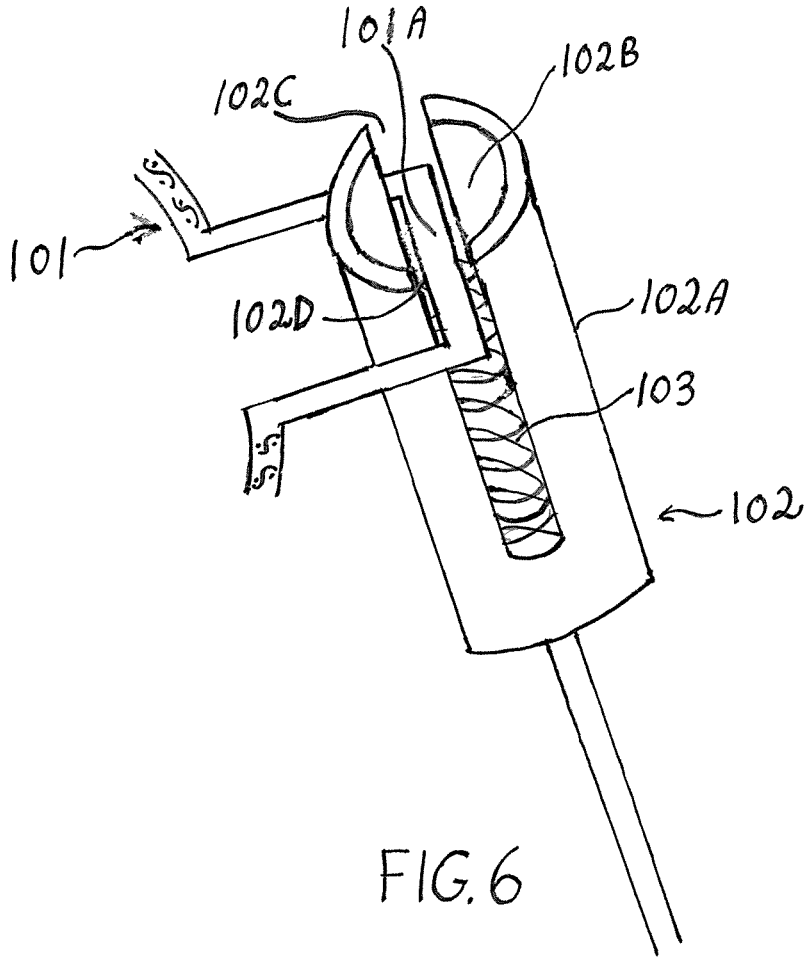
FIG. 6 shows a partial view of the body portion and how it is connected to the setting member in the first embodiment with the connecting portion tensioned against the spring before an end cap is structurally connected.
Figure 7:
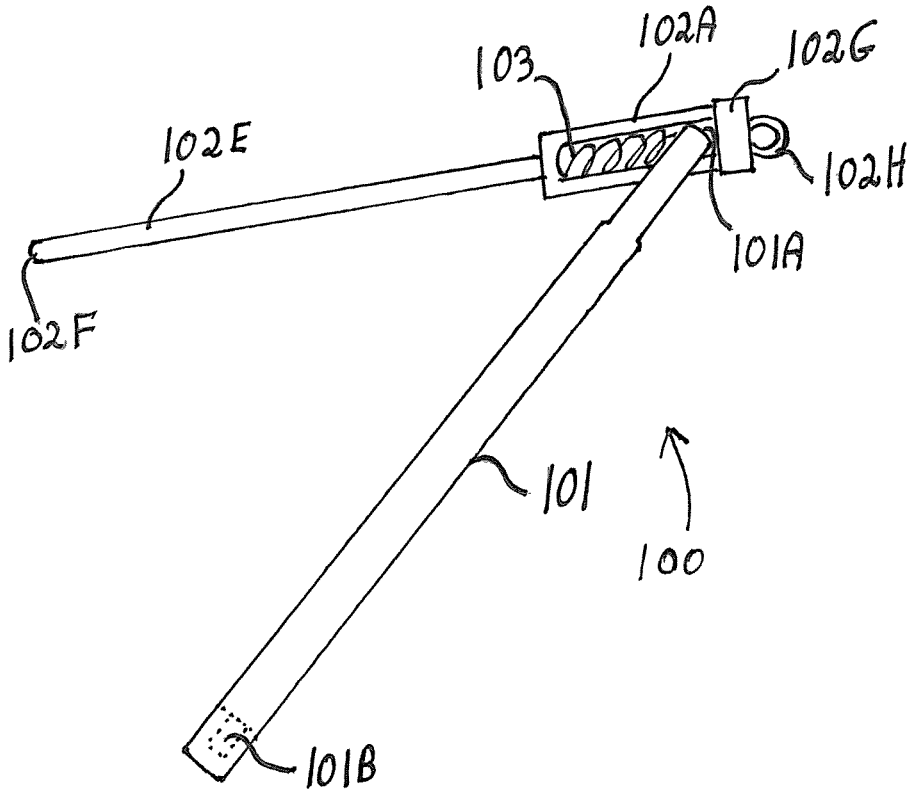
FIG. 7 shows a side view of the first embodiment in the open position before one or more beads is added to the substantially cylindrical stringing portion.

It is to be understood that a tube portion is non-limiting and can be used interchangeably with the term, pipe portion, or other terminologies, and can be square, rectangular or any other shape as required, and has a cavity portion for receiving a spring as shown in FIGS. 5, 6 and 7.

As shown in FIG. 3 (aerial view), FIG. 4, and FIG. 5 the substantially cylindrical tube portion 102*a* comprises a hollow portion 102*b* and further comprises a first cut out groove 102*c* and a second cut out groove 102*d*. The setting member 102 further comprises an end cover 102*g* with a round connector 102*h* as shown in FIGS. 1, 2, 7 and 8. Embodiment 100 further comprises a spring 103; in this embodiment a compression spring as shown in FIGS. 2, 5, 6 and 7.

Connection

As shown in FIGS. 5, 6, 7, and 8 (shown as a cross section), the spring 103 is disposed inside the hollow portion 102*b* of the substantially cylindrical tube portion 102*a*. The setting member 102 is then connected to the body portion 101 (partial view of the body portion 101 in FIG. 6). As shown in FIG. 6, the connecting portion 101*a* is positioned at the opening of the tube portion 102*a* and lined up with the first cut out groove 102*c* and the second cut out groove 102*d*.

The connecting portion 101*a* is pressed against the spring 103 so that the connecting portion 101*a* can move back and forth/up and down the first cut out groove 102*c* and the second cut out groove 102*d* simultaneously, while inside the hollow portion 102*b*, under spring force.

Figure 8:
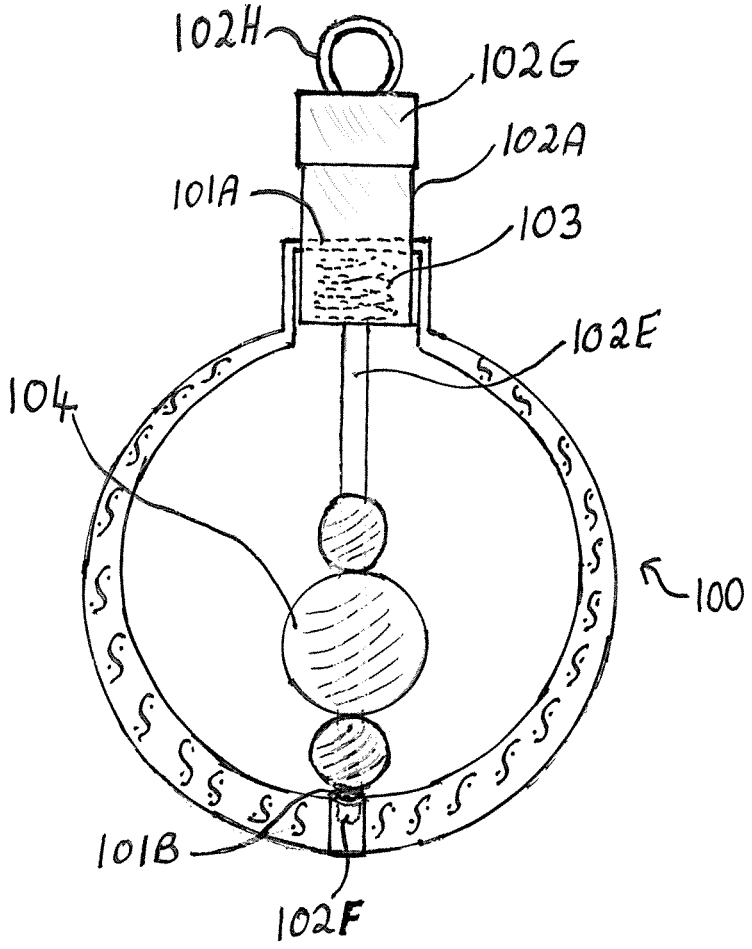
FIG. 8 shows the first embodiment in the closed position with a plurality of releasably set beads. This view shows how the spring force from the spring, forces the distal end of the string portion into the cavity portion of the body portion. The spring and connecting portion are shown as a cross section.

The end cap 102*g* is then structurally connected to the open end of the tube portion 102*a* as shown in FIGS. 1, 7 and 8. This structural connection prevents the connecting portion 101*a* and the spring 103 from dislodging and also maintains a movable connection between the setting member 102 and the body portion 101. Other commonly used jewelry findings such as earring hooks 104 and posts may be connected to the round connector 102*h* to add the complete dangle earring to the ear lobe.

Operation/Function

As shown in FIGS. 1 and 8, the closed position is when the distal end 102*f* (shown as a cross section in FIG. 8), of the stringing portion 102*e* is placed inside the cavity portion 101*b* and is held in the closed position by the downwards spring force supplied by the spring 103.

As shown in FIG. 7 (side view), the open position is when the distal end 102*f* of the stringing portion 102*e* is not placed inside the cavity portion 101*b* (cross section shown) and is not held in the closed position by the spring force supplied by the spring 103.

Starting in the closed position with no releasably set beads 105; while holding the body portion 101 the user pulls back the setting member 102 so that the connecting portion 101*a* of the body portion 101 is tensioned against the spring 103. This now releases the distal end portion 102*f* from the cavity portion 101*b*.

The setting member 102 can now slide back and forth and with multi-directional movement, including oscillatory motion and pivotal rotation, because the connecting portion 101*a* moves up and down (back and forth) etc, through the first groove 102*c* and the second groove 102*d* and inside the hollow portion 102*b* simultaneously.

The user then releases the spring tension on the setting member 102 and adds one or more beads 105 to the substantially cylindrical stringing portion 102*e* of the setting member 102. The user lines up the hole 105*a* on the bead(s) 105 with distal end 102*f* of the stringing portion 102*e* and slides the beads(s) 105 onto the stringing portion 102*e*. The user, while holding the body portion 101 again pulls back the setting member 102 so that the connecting portion 101*a* of the body portion 101 is tensioned against the spring 103.

The user then lines up the distal end 102*f* of the gripping portion 102*e* with the cavity portion 101*b* and releases the spring force so that the distal end portion 102*f* is now disposed inside the cavity portion 101*b* and the one or more beads 105 are releasably set. Substantial spring tension from the spring 103 is maintained to securely hold the distal end 102*f* and the bead(s) 105 in place. One or more beads 105 as shown in FIGS. 1 and 8 may be releasably set in embodiment 100.

To change the bead(s) 105, the user pulls back the setting member 102 so that the connecting portion 101*a* is further tensioned against the spring 103 and the distal end 102*f* is released from the cavity portion 101*b* and the previously outlined steps are repeated.

Alternative Embodiments

It is to be understood that embodiment 100 can be demonstrated using various cosmetic appearances, styles, shapes, and dimensions, while maintaining a single inventive concept. The styles, shapes, dimensions, and cosmetic appearances of jewelry is constantly changing to meet consumer demands so embodiment 100 can be adapted to meet these changes within the single inventive concept.

For example, the shape, position, and configuration of the connecting portion 101*a*, setting member 102, body portion 101, stringing portion 102*e* and other components, can all be adapted and changed to meet the configuration requirements of various types of jewelry such as ring, pendants, earrings etc. Any embodiment may comprise a plurality of components, for example, an embodiment may have a plurality of stringing portions presented in any configuration as required.

Second Embodiment

Figure 9:
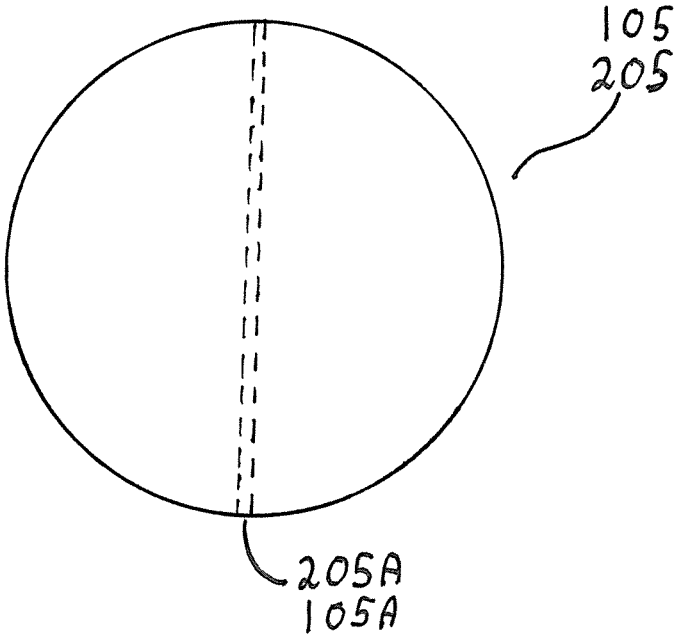
FIG. 9 shows a bead with a hole, the hole shown as a cross-section. This figure is used to describe stringing beads in the first and second embodiments.
Figure 11:
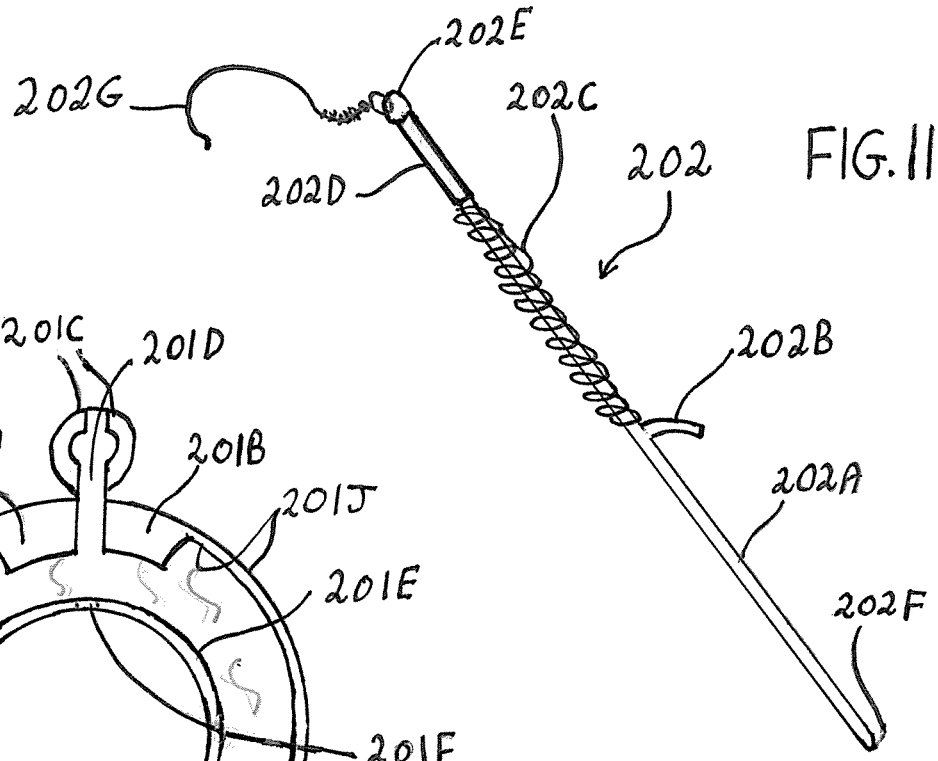
FIG. 11 shows the components of the setting member in the second embodiment.
Figure 10:
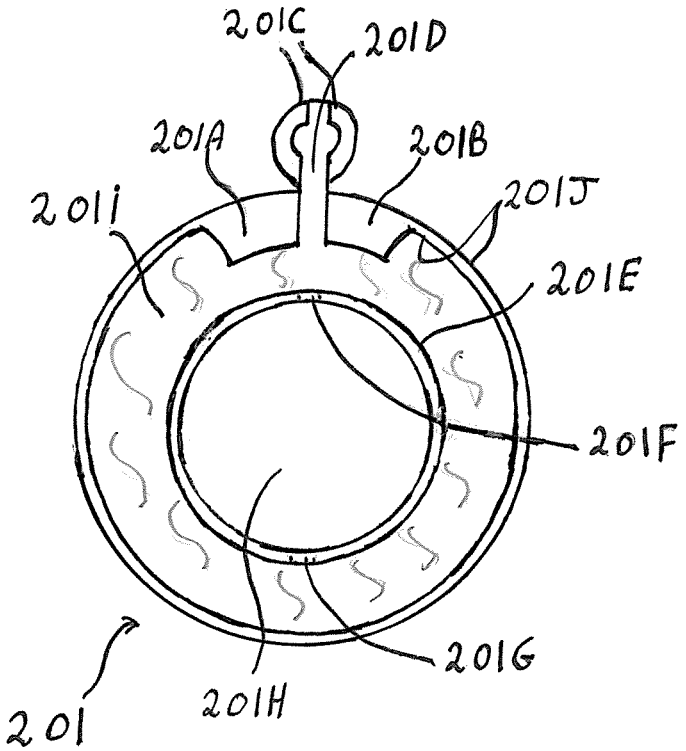
FIG. 10 shows a rear view of the components of the body portion in the second embodiment.
Figure 12:
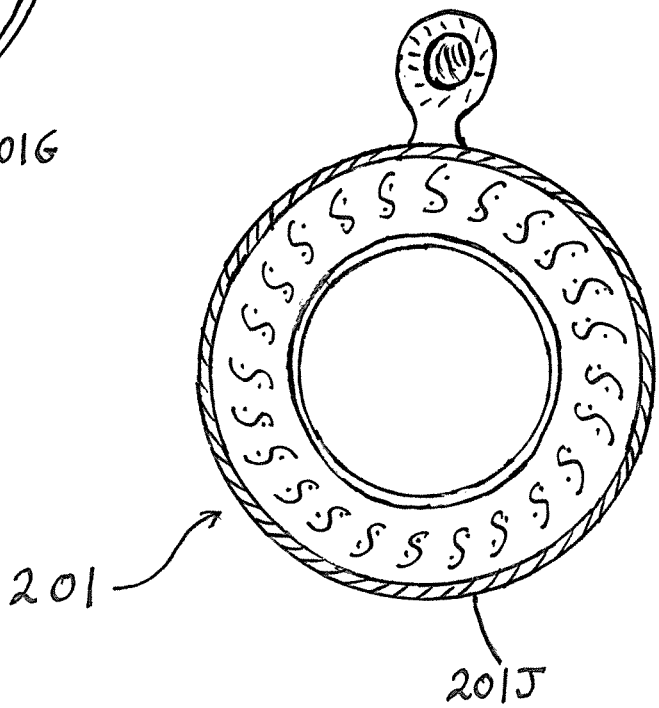
FIG. 12 shows a front view of the body portion in the second embodiment.

FIGS. 10, 11 and 12 shows the components of the second embodiment (embodiment 200), a jewelry item configured to releasably set one or more beads. In this non-limiting configuration, the jewelry item is a dangle earring that releasably sets a single bead 205 (FIGS. 9 and 15), However, the subsequent demonstrated structure, function and connection can be adapted to other types of jewelry such as but not limited to rings, pendants, and bracelets, while keeping within the scope of the inventive concept, and can also releasably set a plurality of beads 205.

Structure

Figure 13:
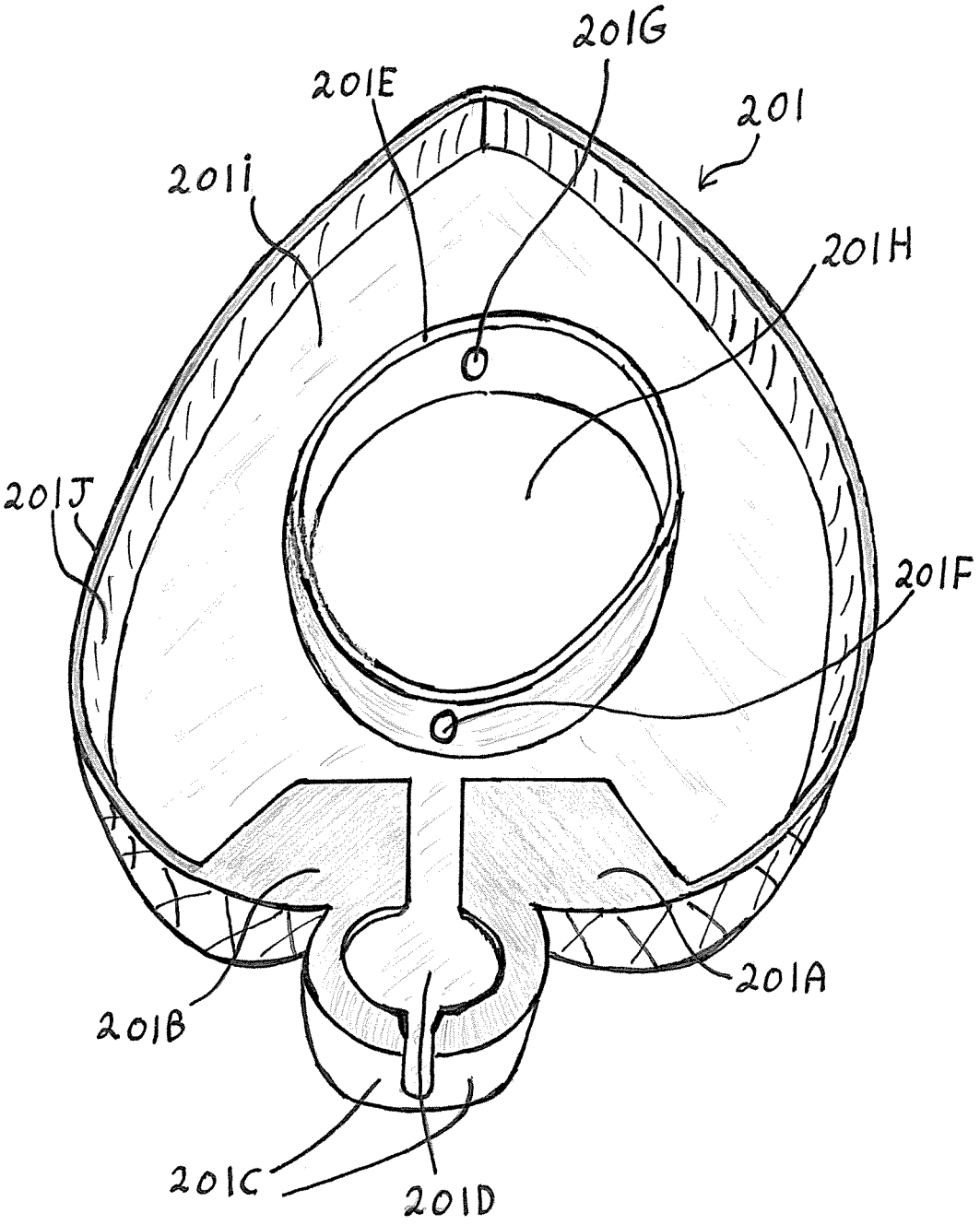
FIG. 13 shows a rear view of the body portion of the second embodiment. In this embodiment the body portion is substantially a heart shape.

As shown in FIGS. 10 and 13 (rear views), embodiment 200 comprises a body portion 201; the body portion 201 comprises a first connecting portion 201*a* and a second connecting portion 201*b*. The first and second connecting portions 201*a* and 201*b* respectively, are identical. Other alternative embodiments may comprise only one connecting portion. Note that the embodiment of the body portion 201 in FIG. 13 is a different shape, substantially heart shape, but within the inventive concept.

The body portion 201 further comprises a tensioning portion 201*c*, and a channel portion 201*d*. The body portion 201 further comprises a substantially cylindrical holding portion 201*e*. In other embodiments a holding portion may be different shapes.

The substantially cylindrical holding portion 201*e* further comprises a first cavity portion 201*f* and a second cavity portion 201*g*, (both shown as a cross section in FIG. 10). The body portion 201 further comprises a hole 201*h*, where a bead 205 is placed and releasably set. The body portion 201 further comprises a rear flat face 201*i* and a wall portion 201J. FIG. 12 is a front view of the body portion.

As shown in FIG. 11, embodiment 200 further comprises a setting member 202, the setting member 202 further comprises a substantially cylindrical stringing portion 202*a*; and the distal end 202*f*, is the portion at the end of the substantially cylindrical stringing portion 202*a*. The setting member 202 further comprises a connecting hook 202*b*, and a spring 202*c*, in this embodiment a compression spring.

The setting member 202 further comprises an end cap 202*d* with a round connector 202*e*. Other commonly used jewelry findings such an earring hook 202*g* or posts can be added to the round connector 202*e* at user's discretion to add the complete dangle earring to the ear lobe.

Figure 15:
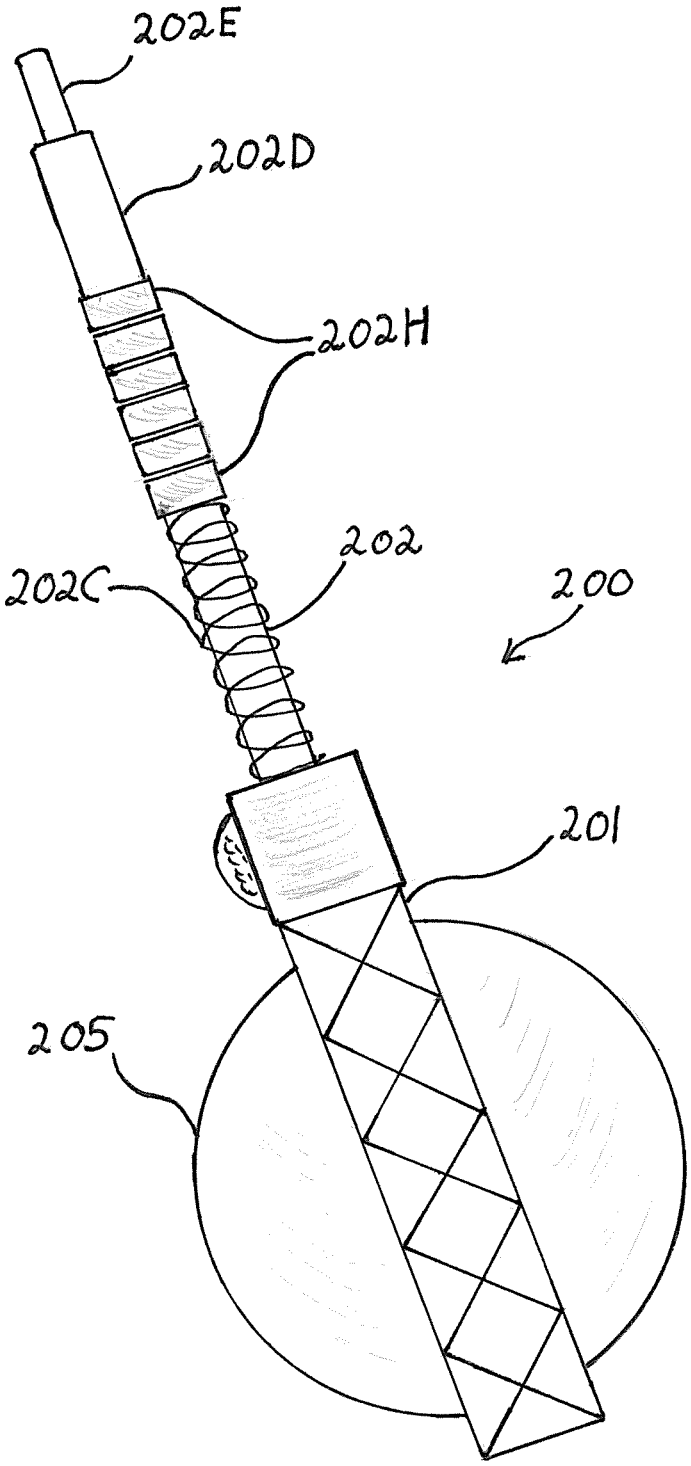
FIG. 15 shows a side view of the second embodiment with a releasable set bead.

It is to be noted, as shown in FIG. 15 that other as components such as, but not limited to spacer beads 202*h* can be strung to the upper portion of the substantially cylindrical stringing portion 202*a* and configured between the spring 202*c* and the end cap 202*d*. The spacer beads 202*h* and particularly the spacer bead 202*h* adjacent to the spring 202*c*, acts as a tensioning portion for one end of the spring 202*c*, in the same way that an embodiment with the end cap 202*d* by itself, without any added spacer bead(s) 202*h*, acts as a tensioning portion for one end of the spring 202*c*.

Connection, Operation/Function

As shown in FIG. 11, it is to be noted that the upper portion of the substantially stringing portion 202*a* is the portion above the connecting hook 202*b*, adjacent to the spring 202*c* and the end cap 202*d*. In the setting member 202, the spring 202*c* is disposed around the upper portion of the substantially cylindrical stringing portion 202*a* and above the connecting hook 202*b*.

Figure 14:
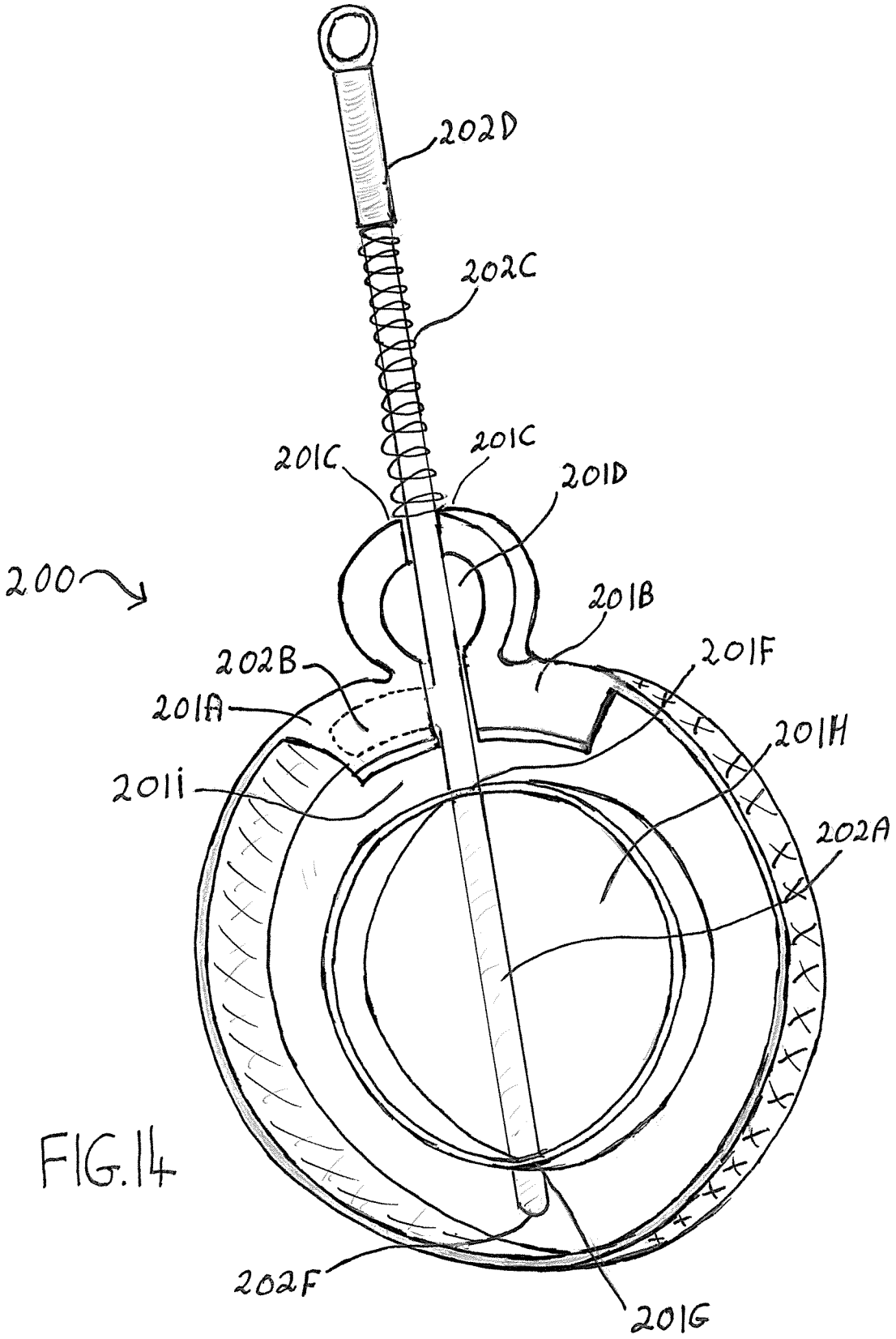
FIG. 14 shows a rear view of the second embodiment and how the setting member is releasably set to the body portion.

In this embodiment the end cap 202*d* is then structurally connected over the upper portion of the substantially cylindrical stringing portion 202*a*. The end cap 202*d* prevents the spring 202*c* from dislodging and also acts as a tensioning point for one end of the spring 202*c* as shown in FIGS. 11 and 14. The spring 202*c*, when tensioned, moves back and forth along the upper portion of the substantially cylindrical stringing portion 202*a*, and between the portion of the end cap 202*d* adjacent to the spring 202*c* and the connecting hook 202*b*.

The setting member 202 is now ready to be connected to the body portion 201. As shown in FIG. 14, the connection is achieved when the distal end 202*f* of the stringing portion 202*a* is inserted through the channel portion 201*d*, while the connecting hook 202*b* is kept in a vertical position (not shown), so that it also slides through the channel portion 201*d*.

The distal end 202*f* of the stringing portion 202*a* is then placed at the opening of the first cavity portion 201*f* (shown as a cross section in FIG. 14). At this point a bead(s) 205 may be added to the stringing portion 202*a* (bead not shown in FIG. 14). The user places a bead inside the hole 201*h*, and lines up the bead hole 205*a* (see FIG. 9), with the first cavity portion 201*f* and the second cavity portion 201*g*.

The distal end 202*f* of the stringing portion 202*a* is then inserted through the first cavity portion 201*f*, through the bead hole 205*a* and through the second cavity portion 201*g*. A substantial part of the stringing portion 202*a* below the connecting hook 202*b* is now inserted through the first cavity portion 201*f*, the bead 205, and the second cavity portion 201*g*; the bead 205 is now held inside the hole 201*h* between the substantially circular holding portion 201*e*.

When the connecting hook 202*b* that is held in a vertical position, touches against the holding portion 201*e* adjacent to the first cavity portion 201*f*, there is now significant tension on the spring 202*c* because the spring 202*c* is also being tensioned against the tensioning portion 201*c* of the body portion 201. While maintaining this spring tension the user then rotates the setting member 202 sideways to either the right or left side until the connecting hook 202*b* now lies horizontal with the rear flat face 201*i*.

The user then releases enough spring tension so that the connecting hook 202*b* slides beneath either the first connecting portion 201*a* or the second connecting portion 201*b*, which ever connecting portion the user has chosen. The released spring tension from the spring 202*c* forces the connecting hook 202*b* against the wall portion 201*j* and beneath the chosen connecting portion 201*a* or 201*b*. It is to be noted that there is a gap between the connecting portions 201*a* and 201*b*, and the rear flat face 201*i* where the connecting hook 202*b* is secured.

It is to be noted that significant spring tension from the spring 202*c* is maintained so the connecting hook 202*b* cannot dislodge until manipulated by the user because the spring tension from the spring 202*c* forces it to be held in position below the chosen connecting portion 201*a* or 201*b* and against the wall portion 201*j*, (not shown, as this part of the wall portion 201*j* is covered by the first cavity portion 201*f* and the second cavity portion 201*g*). The setting member 202 with a bead 205 is now releasably set to the body portion 201 as the spring force from the spring 202*c* assists holding it in place.

To release the setting member 202 and the bead 205, the user pushes the setting member 201 towards the holding portion 201*e* so that the connecting hook 202*b* is no longer contacting the wall portion 201*j* and the chosen connecting portion 201*a* or 201*b*. When contact is made, the user then rotates the setting member 202 so that the connecting hook 202*b* is placed back in a vertical position to slide back out of the channel portion 201*d*. The user then releases the spring tension from the spring 202*c* so that the stringing portion 202*a*, connecting hook 202*b*, and the bead 205, can be removed from the body portion 201. FIG. 15 is a side view showing a releasably set bead in embodiment 200.

Alternatives/Variations

Different types of jewelry items including but not limited to rings, pendants, earrings, necklaces, bracelets, anklets, bangles, chains, toe rings, pins, charms, brooches, cuff links, jewelry findings, connectors, tie pins, key chains, and lockets can be configured to releasably set one or more beads.

Different types of jewelry items configured to releasably set one or more beads can comprise a disc, a piece of rigid material, eyewear, buckles, clothing, shoes, handbags, hair clips, fashion items, decorative items, watches, pet jewelry, etc, and can be expressed in a variety of different shapes and styles within the inventive concept.

Springs

The configuration of an embodiment will determine the number, type and position of springs configured within the embodiment. Using embodiment 100 as a non-limiting example; although embodiment 100 comprises one compression spring one skilled in the art could configure other types and numbers of springs or spring assemblies in embodiment 100 and other embodiments. Those skilled in the art will understand that using an alternative type of spring or a plurality of springs in an embodiment, may mean that some components of the embodiment may need to be re-configured.

Setting Members

It is to be noted that setting members can be configured to any size, type, shape, and dimension as required and disposed in any portion of an embodiment as required. The disclosed embodiments demonstrate a substantially cylindrical stringing portion in the setting members but they can be modified as explained above.

It is to be noted that a cavity portion for holding the distal end of a stringing portion can be other configurations besides a hole type cavity. The shape, type, and size of the cavity portion for holding the distal end of a stringing portion will depend on the jewelry item it is configured to.

Embodiment Materials

It is to be understood that the materials used in embodiments comprises any known materials and combinations of materials without limitation, such as gold, silver, platinum, rhodium, other precious metals, titanium, tungsten, stainless steel, steel, brass, bronze, tin, aluminium, alloys, any other metals, minerals, glass, wood, plastics, resins, leather, PVC, polypropylene, polycarbonate, and the like.

CONCLUSIONS, RAMIFICATIONS AND SCOPE

Each of the embodiments of the invention and any other subsequent embodiments conceived later, can be expressed in a plurality of components, alternatives, variations, and configurations, cosmetic appearances, shapes, styles, and sizes, without departing from the scope of the invention. This is because of the customizable nature of the embodiments and the different types of jewelry items and other items that the embodiments comprise.

It is to be noted that where the various embodiments, alternatives, variations, configurations, etc, of the invention is outlined, that all of the details of each of the embodiments and alternatives, variations, and configurations, etc, may be applicable to every other embodiment, alternatives, variations, and configurations, etc, even if not specifically mentioned. They may also be applicable to other embodiments, variations, and alternatives, configurations, etc, in keeping within the scope of the invention, even though not revealed within this disclosure that may be conceived at a later time.

In addition, while a particular feature of the invention may have been disclosed with respect to only one of several embodiments, such features may be combined with one or more other features of the other embodiments as may be desired and advantageous for any given or particular application.

Although the invention has been shown and described with respect to certain embodiments, variations, and alternatives, configurations, etc, it is obvious that equivalent alterations and modifications will occur to others skilled in the art upon the reading and understanding of this specification and the annexed drawings.

In particular regard to the various operations/functions performed by the above described components the terms, (including a reference to a "function" and "operation") used to describe components, are intended to correspond, unless otherwise indicated, to any component which performs the specified operation/function of the described component (i.e. that is functionally equivalent), even though not structurally equivalent to the disclosed structure which performs the operation/function in the herein illustrated exemplary embodiments of the invention.

Furthermore, to the extent that the terms "including", "includes", "having", "has", "with", or variants thereof that are used in either the detailed description or the claims, such terms are intended to be inclusive in a similar manner to the term "comprising."

What is claimed is:

1. A jewelry item configured with components to releasably set one or more interchangeable beads comprising:

a setting member comprising a stringing portion and a first connecting portion, the stringing portion is configured to receive one or more of the interchangeable beads, and;

a body portion comprising a second connecting portion to receive the first connecting portion, and a cavity portion to receive the stringing portion, the first connecting portion of the setting member is slidably and pivotally connected to the second connecting portion, and;

a spring configured adjacent to the setting member and the body portion, the setting member is releasably set between a closed position wherein the setting member is held in the closed position by a force applied by the spring, and an open position wherein the setting member is released from the spring force holding the setting member in the closed position.

2. The jewelry item of claim 1, wherein the jewelry item further comprises an end cap.

3. The jewelry item of claim 1, wherein the jewelry item further comprises one or more beads.

4. The jewelry item of claim 1, wherein the jewelry item is selected from the group comprising: rings, earrings, pendants, bracelets, bangles, lockets, anklets, piercings, charms, brooches, cuff links and necklaces.

5. A jewelry item configured with components to releasably set one or more interchangeable beads comprising:

a setting member comprising a tube portion, and a stringing portion, the tube portion further comprising a hollow portion and a first cut out groove and a second cut out groove, the stringing portion further comprising a distal end, the stringing portion is configured to receive one or more of the interchangeable beads and;

a body portion comprising a connecting portion and a cavity portion, the connecting portion receives the tube portion, and the cavity portion receives the distal end of the stringing portion, and;

a spring disposed adjacent to the tube portion and the connecting portion, the connecting portion moves adjacent to the spring, the tube portion and the first cut out groove and the second cut out groove, the setting member is releasably set between a closed position wherein the distal end of the stringing portion extends into the cavity portion and is held in the closed position by a force applied by the spring, and an open position wherein the distal end of the stringing portion is released from the spring force holding the setting member in the closed position.

6. The jewelry item of claim 5, wherein the setting member further comprises an end cap.

7. The jewelry item of claim 5, wherein the jewelry item further comprises one or more beads.

8. The jewelry item of claim 5, wherein the jewelry item is selected from the group comprising: rings, earrings, pendants, bracelets, bangles, lockets, anklets, piercings, charms, brooches, cuff links and necklaces.

9. A jewelry item configured with components to releasably set one or more interchangeable beads comprising:

a setting member comprising a stringing portion, a connecting hook, a spring, and a first tensioning portion, the stringing portion further comprising a distal end, the stringing portion is configured to receive one or more of the interchangeable beads, the spring is disposed adjacent to the connecting hook and the first tensioning portion, and;

a body portion comprising a second tensioning portion, a holding portion, a channel portion, and a connecting portion, the holding portion further comprising a first cavity portion and a second cavity portion, the setting member is releasably set between a closed position wherein the distal end of the stringing portion extends through the channel portion and through the first cavity portion and the second cavity portion, the connecting hook is disposed adjacent to the connecting portion, and held in the closed position by a force applied by the spring, and an open position wherein the connecting hook is released from the spring force holding the setting member in the closed position.

10. The jewelry item of claim 9, wherein the setting member further comprises an end cap.

11. The jewelry item of claim 9, wherein the jewelry item further comprises one or more beads.

12. The jewelry item of claim 9, wherein the jewelry item is selected from the group comprising: rings, earrings, pendants, bracelets, bangles, lockets, anklets, piercings, and necklaces.

* * * * *